United States Patent [19]

Nishikawa et al.

[11] Patent Number: 4,721,931

[45] Date of Patent: Jan. 26, 1988

[54] STRIPLINE FILTER

[75] Inventors: Toshio Nishikawa, Nagaokakyo; Youhei Ishikawa, Kyoto; Jun Hattori, Nagaokakyo; Hideyuki Kato, Ootsu, all of Japan

[73] Assignee: Murata Manufacturing Co., Ltd., Japan

[21] Appl. No.: 44,817

[22] Filed: Apr. 30, 1987

[30] Foreign Application Priority Data

May 2, 1986 [JP] Japan ..... 61-102809

[51] Int. Cl.[4] ..... H01P 1/203; H01P 7/08

[52] U.S. Cl. ..... 333/203; 333/204; 333/219; 333/246

[58] Field of Search ..... 333/203, 204, 205, 202, 333/222, 223, 246, 219, 245, 208–212

[56] References Cited

U.S. PATENT DOCUMENTS 4,599,586 7/1986 Brown ..... 333/202 X 4,641,116 2/1987 Shibata et al. ..... 333/202 X

*Primary Examiner*—Marvin L. Nussbaum

*Attorney, Agent, or Firm*—Ostrolenk, Faber, Gerb & Soffen

[57] ABSTRACT

A stripline filter includes a cylindrical substrate made of a dielectric material and having inner and outer surfaces with opposite ends thereof opened. A ground electrode is deposited on the inner surface, and on the inner surface, interdigitated electrodes are deposited. Alternately, the ground electrode may be deposited on the outer surface, and the interdigitated electrodes may be deposited on the inner surface. Thus, the stripline filter can be arranged in a compact size. Also, the ground electrode provided on the outer surface prevents electromagnetic waves generated from the interdigitated electrodes from being emitted out.

8 Claims, 6 Drawing Figures

STRIPLINE FILTER

BACKGROUND OF THE INVENTION

1. Field of the Invention

The present invention relates to a stripline filter which is used, for example, in a bandpass filter.

2. Description of the Prior Art

A prior art stripline filter is shown in FIG. 1, which is a five stage interdigitated type. In FIG. 1, a reference number 20 designates a dielectric substrate of a rectangular shape having top and bottom flat faces. A bottom flat face (can not be seen in FIG. 1) is deposited entirely with a ground electrode 21. Opposite sides of ground electrode 21 extends around substrate 20 at opposite sides thereof and are connected to side electrodes 21*a* and 21*b* which are located at peripheral and opposite side edge portions of the top flat face.

From side electrode 21*a*, three resonance electrodes 22, 23 and 24 extend parallel to each other towards opposite side electrode 21*b*. Similarly, from side electrodes 21*b*, two resonance electrodes 27 and 28 extend parallel to each other towards opposite side electrode 21*a* in an interdigitated manner with three resonance electrodes 22, 23 and 24. Resonance electrodes 22 and 24 located at opposite ends are provided with terminal electrodes 25 and 26 for the external connection. It is to be noted that each of resonance electrodes 22, 23, 24, 27 and 28 has a short-circuit end connected to the side electrode and open-circuit end spaced away from the side electrode.

Another prior art stripline filter is shown in FIG. 4, which is a five stage combline type. When compared with the filter shown in FIG. 1, the filter shown in FIG. 4 has five resonance electrodes 22, 23, 24, 27 and 28, which extend parallel to each other from side electrode 21*a*. Also, there is no side electrode 21*b*.

Stripline filters such as described above are widely used in bandpass filters. As the number of the stripline filters employed increases, the attenuation characteristic of the bandpass filter is improved. Therefore, the number of the stripline filters employed in one bandpass filter has been increased, but resulting in bulky in size and requires a large space to align the stripline filters. Furthermore, when the stripline filters are employed in a microwave filter, a problem arises that the electromagnetic wave leaks outside more than an amount which can be disregarded.

SUMMARY OF THE INVENTION

The present invention has been developed with a view to substantially solving the above described disadvantages and has for its essential object to provide an improved stripline filter which can be arranged in a compact size.

It is also an essential object of the present invention to provide a stripline filter which produces less electromagnetic wave leakage, when it is employed in a microwave filter.

In accomplishing these and other objects, a stripline filter according to the present invention comprises a cylindrical substrate made of a dielectric material and having inner and outer surfaces with opposite ends thereof opened. A ground electrode is deposited on the inner surface, and on the inner surface, interdigitated electrodes are deposited. Alternately, the ground electrode may be deposited on the outer surface, and the interdigitated electrodes may be deposited on the inner surface. Thus, the stripline filter according to the present invention can be arranged in a compact size. Also, the ground electrode provided on the outer surface prevents electromagnetic waves generated from the interdigitated electrodes from being emitted out.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
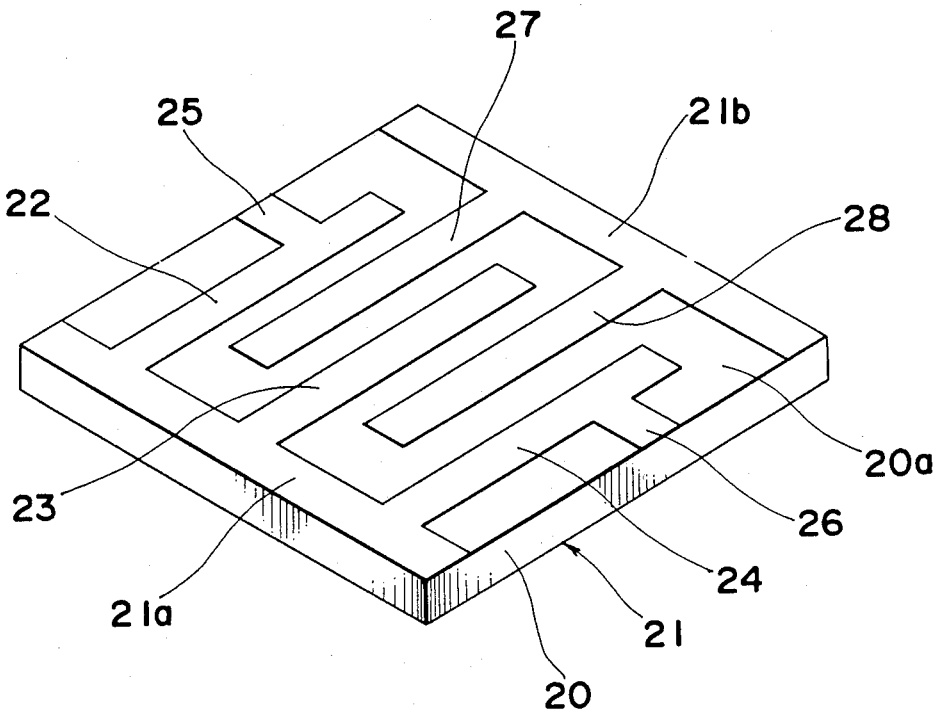
Fig. 1 PRIOR ART
FIG. 1 is a perspective view of a stripline filter according to prior art.
Figure 2:
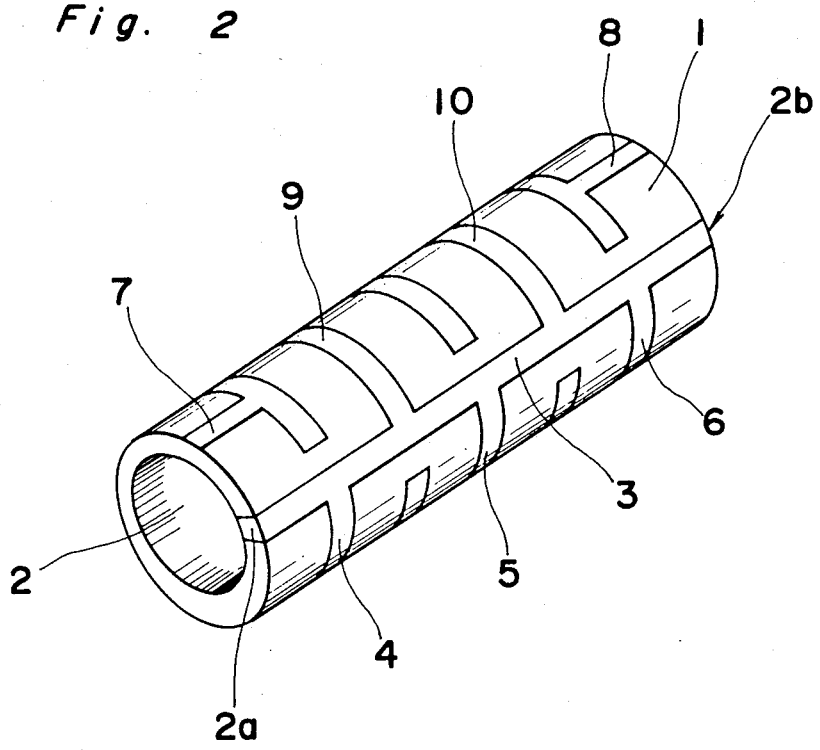
FIG. 2 is a perspective view of a stripline filter according to a first embodiment of the present invention.

Referring to FIG. 2, a five stage interdigitated type stripline filter according to a first embodiment of the present invention is shown. The stripline filter comprises a substrate 1 made of a dielectric material and arranged in a shape of cylinder having inner and outer surfaces with opposite ends thereof opened. The inner surface of the cylinder substrate 1 is entirely deposited with a ground electrode 2.

A runner electrode 3 having a predetermined width extends on the outer surface of the cylinder is parallel to the cylinder axis. One end of runner electrode 3 is connected to ground electrode 2 through a connecting electrode 2*a* deposited on one end face of the cylinder, and the other end of runner electrode 3 is connected to ground electrode 2 through a connecting electrode 2*b* deposited on the other end face of the cylinder.

From runner electrode 3, three resonance electrodes 4, 5 and 6 extend parallel to each other with a predetermined spacing and along the outer surface circumference of the cylinder. Resonance electrodes 4, 5 and 6 terminate before making one complete turn, i.e., away from runner electrode 3. Similarly, from runner electrode 3, two resonance electrodes 9 and 10 extend in the direction opposite to resonance electrodes 4, 5 and 6 and parallel to each other in an interdigitated manner with respect to resonance electrodes 4, 5 and 6. Resonance electrodes 9 and 10 terminate before making one complete turn, i.e., away from runner electrode 3. The resonance electrodes 4 and 6 located at opposite ends have terminal electrodes 7 and 8, respectively, extending to the opposite edges of the cylinder for the external electric connection.

It is to be noted that each of resonance electrodes 4, 5, 6, 9 and 10 has a short-circuit end connected to the runner electrode 3 and open-circuit end spaced away from the runner electrode 3.

Figure 3:
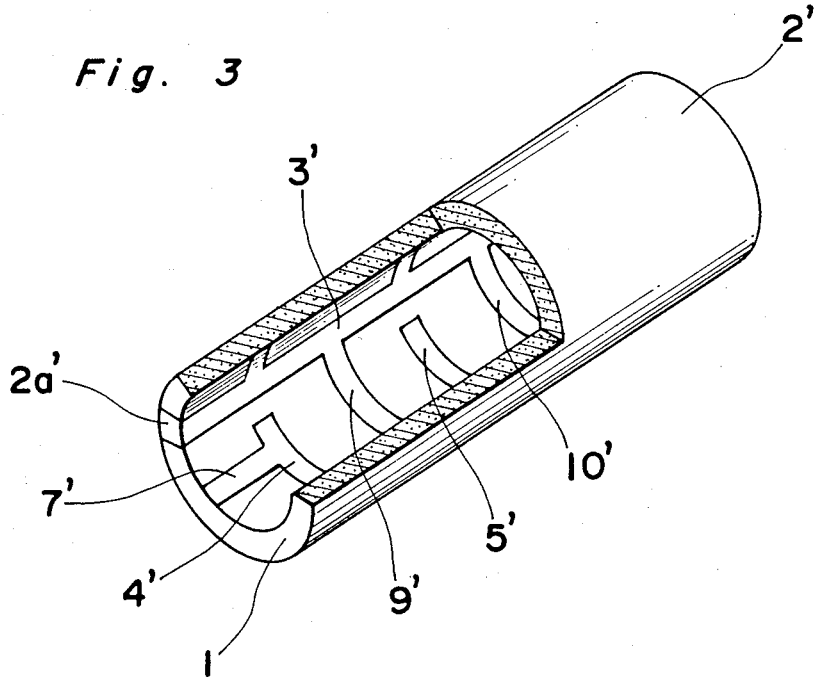
FIG. 3 is a perspective view of a stripline filter according to a second embodiment of the present invention.
Figure 4:
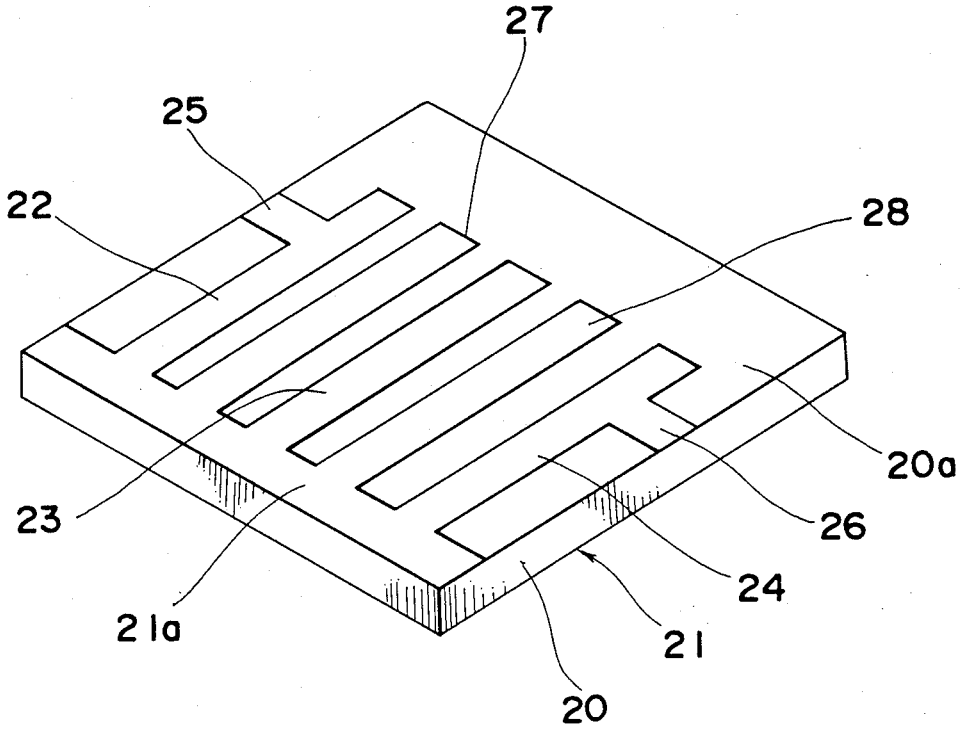
Fig. 4 PRIOR ART
FIG. 4 is a perspective view of a stripline filter according to prior art.

Referring to FIG. 3, a stripline filter according to a second embodiment of the present invention is shown. In the first embodiment, the ground electrode is deposited on the inner surface of the cylinder substrate 1 and the interdigitated electrodes are deposited on the outer surface of the cylinder substrate 1, but in the second embodiment, the ground electrode is deposited on the outer surface of the cylinder substrate 1 and the interdigitated electrodes are deposited on the inner surface of the cylinder substrate 1, as described below.

The stripline filter shown in FIG. 3 comprises cylinder substrate 1 having inner and outer surfaces with opposite ends thereof opened. The outer surface of the cylinder substrate 1 is entirely deposited with a ground electrode 2'.

A runner electrode 3' having a predetermined width extends on the inner surface of the cylinder in parallel to the cylinder axis. The opposite ends of runner electrode 3' are connected to ground electrode 2', respectively, through connecting electrodes 2a' and 2b' deposited on end faces of the cylinder.

From runner electrode 3', three resonance electrodes 4', 5' and 6' (only two are shown) extend parallel to each other with a predetermined spacing and along the inner surface circumference of the cylinder. Resonance electrodes 4', 5' and 6' terminate before making one complete turn, i.e., away from runner electrode 3'. Similarly, from runner electrode 3', two resonance electrodes 9' and 10' extend in the direction opposite to resonance electrodes 4', 5' and 6' and parallel to each other in an interdigitated manner with respect to resonance electrodes 4', 5' and 6'. Resonance electrodes 9' and 10' terminate before making one complete turn, i.e., away from runner electrode 3'. The resonance electrodes 4' and 6' located at opposite ends have terminal electrodes 7' and 8' (only one is shown), respectively, extending to the opposite edges of the cylinder for the external electric connection.

The stripline filter according to the present invention is not limited to the five stage interdigitated type having five resonance electrodes, but can have any other number. Furthermore, the stripline filter according to the present invention is applicable not only to the interdigitated type but also to a combline type or any other type. An example of the combline type is described hereinbelow.

Figure 5:
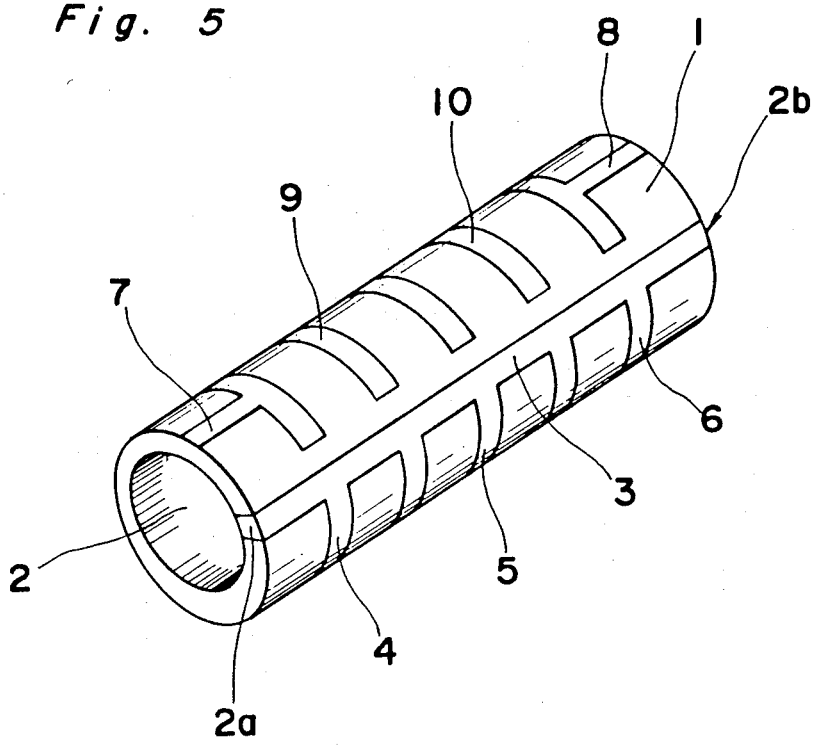
FIG. 5 is a perspective view of a stripline filter according to a modification of the first embodiment of the present invention.

Referring to FIG. 5, a five stage combline type stripline filter according to a modification of the first embodiment of the present invention is shown. When compared with the stripline filter of FIG. 2, the only difference is that the filter shown in FIG. 5 has five resonance electrodes 4, 5, 6, 9 and 10 which extend from runner electrode 3 and parallel to each other with a predetermined spacing and along the outer surface circumference of cylinder 1.

Figure 6:
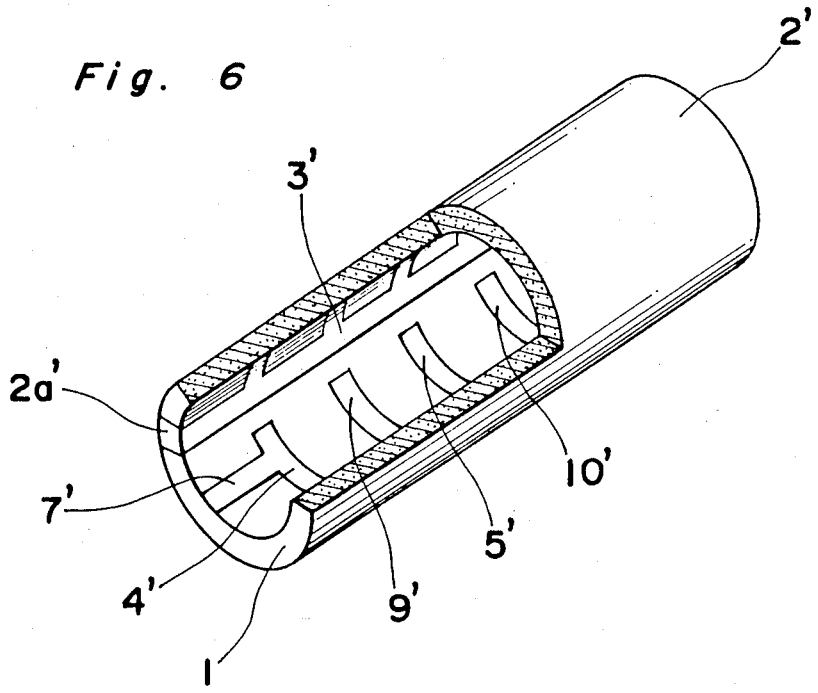
FIG. 6 is a perspective view of a stripline filter according to a modification of the second embodiment of the present invention.

Referring to FIG. 6, a five stage combline type stripline filter according to a modification of the second embodiment of the present invention is shown. When compared with the stripline filter of FIG. 3, the only difference is that the filter shown in FIG. 6 has five resonance electrodes 4', 5' 6', 9' and 10' (only four are shown) which extend from runner electrode 3' and parallel to each other with a predetermined spacing and along the inner surface circumference of cylinder 1.

As has been fully described above, the stripline filter of the present invention can be arranged in a compact size. Also, the stripline filter of the second embodiment has the ground electrode deposited entirely on the outer surface providing a shielding effect. Thus, it is possible to reduce or prevent the electromagnetic waves produced around the resonance electrodes from being emitted out from the stripline filter. And, also it is possible to cut off or reduce any electromagnetic waves coming into the stripline filter.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A stripline filter comprising:

a substrate made of a dielectric material and arranged in a shape of cylinder having inner and outer surfaces with opposite ends thereof opened;

a ground electrode deposited on said inner surface;

a runner electrode deposited on said outer surface and extending between opposite ends of said cylindrical substrate, said runner electrode being electrically connected at opposite ends thereof with said ground electrode;

first resonance electrodes extending from said runner electrode along said outer surface circumference of the cylindrical substrate with a predetermined spacing, and terminating away from said runner electrode; and second resonance electrodes extending, in a direction opposite to said first resonance electrodes, from said runner electrode along said outer surface circumference of the cylindrical substrate and terminating away from said runner electrode such that said first and second resonance electrodes are interdigitated.

2. A stripline filter as claimed in claim 1, further comprising a first terminal electrode connected to a resonance electrode located adjacent one end of said cylindrical substrate, and a second terminal electrode connected to a resonance electrode located adjacent other end of said cylindrical substrate.

3. A stripline filter comprising:

a substrate made of a dielectric material and arranged in a shape of cylinder having inner and outer surfaces with opposite ends thereof opened;

a ground electrode deposited on said outer surface;

a runner electrode deposited on said inner surface and extending between opposite ends of said cylindrical substrate, said runner electrode being electrically connected at opposite ends thereof with said ground electrode;

first resonance electrodes extending from said runner electrode along said inner surface circumference of the cylindrical substrate with a predetermined spacing, and terminating away from said runner electrode; and second resonance electrodes extending, in a direction opposite to said first resonance electrodes, from said runner electrode along said inner surface circumference of the cylindrical substrate and terminating away from said runner electrode such that said first and second resonance electrodes are interdigitated.

4. A stripline filter as claimed in claim 3, further comprising a first terminal electrode connected to a resonance electrode located adjacent one end of said cylindrical substrate, and a second terminal electrode connected to a resonance electrode located adjacent other end of said cylindrical substrate.

5. A stripline filter comprising:

a substrate made of a dielectric material and arranged in a shape of cylinder having inner and outer surfaces with opposite ends thereof opened;

a ground electrode deposited on said inner surface;

a runner electrode deposited on said outer surface and extending between opposite ends of said cylindrical substrate, said runner electrode being electrically connected at opposite ends thereof with said ground electrode; and resonance electrodes extending from said runner electrode along said outer surface circumference of the cylindrical substrate with a predetermined spacing, and terminating away from said runner electrode.

6. A stripline filter as claimed in claim 5, further comprising a first terminal electrode connected to a resonance electrode located adjacent one end of said cylindrical substrate, and a second terminal electrode connected to a resonance electrode located adjacent other end of said cylindrical substrate.

7. A stripline filter comprising:

a substrate made of a dielectric material and arranged in a shape of cylinder having inner and outer surfaces with opposite ends thereof opened;

a ground electrode deposited on said outer surface;

a runner electrode deposited on said inner surface and extending between opposite ends of said cylindrical substrate, said runner electrode being electrically connected at opposite ends thereof with said ground electrode; and resonance electrodes extending from said runner electrode along said inner surface circumference of the cylindrical substrate with a predetermined spacing, and terminating away from said runner electrode.

8. A stripline filter as claimed in claim 7, further comprising a first terminal electrode connected to a resonance electrode located adjacent one end of said cylindrical substrate, and a second terminal electrode connected to a resonance electrode located adjacent other end of said cylindrical substrate.

* * * * *